US008613593B2

(12) United States Patent
Ottow et al.

(10) Patent No.: US 8,613,593 B2
(45) Date of Patent: Dec. 24, 2013

(54) ENGINE CASE SYSTEM FOR A GAS TURBINE ENGINE

(75) Inventors: Nathan Wesley Ottow, Indianapolis, IN (US); Vance A. Mahan, Martinsville, IN (US); Albert Wong, Fishers, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 585 days.

(21) Appl. No.: 12/642,271

(22) Filed: Dec. 18, 2009

(65) Prior Publication Data

US 2011/0008165 A1 Jan. 13, 2011

Related U.S. Application Data

(60) Provisional application No. 61/203,893, filed on Dec. 30, 2008.

(51) Int. Cl.
*F01D 25/28* (2006.01)

(52) U.S. Cl.
USPC ..... 415/213.1; 415/214.1

(58) Field of Classification Search
USPC ..... 415/69, 182.1, 213.1, 214.1, 215.1, 415/173.1
See application file for complete search history.

(56) References Cited

U.S. PATENT DOCUMENTS

| | | | | |
|---|---|---|---|---|
| 3,575,528 | A | 4/1971 | Beam, Jr. et al. | |
| 3,610,772 | A | 10/1971 | Wagle | |
| 3,937,013 | A | 2/1976 | Aspinwall | |
| 4,089,617 | A | 5/1978 | Koeller | |
| 4,349,291 | A | 9/1982 | Geary, Jr. | |
| 4,725,206 | A | 2/1988 | Glaser et al. | |
| 5,235,812 | A | 8/1993 | Klaass et al. | |
| 5,344,285 | A * | 9/1994 | O'Sullivan et al. | 415/199.2 |
| 5,664,413 | A | 9/1997 | Kington et al. | |
| 6,062,813 | A * | 5/2000 | Halliwell et al. | 415/174.5 |
| 6,390,771 | B1 * | 5/2002 | Gervais et al. | 415/139 |
| 2008/0019831 | A1 * | 1/2008 | Kajiwara et al. | 415/214.1 |

* cited by examiner

*Primary Examiner* — Edward Look
*Assistant Examiner* — William Grigos
(74) *Attorney, Agent, or Firm* — Krieg DeVault LLP

(57) ABSTRACT

The present invention provides engine case systems for gas turbine engines. Embodiments of the engine case systems include a plurality of ring cases and a tie-bolt case. The ring cases may house blades and vanes for the compressor and/or for the turbine. The ring cases may be stacked in series, and may be clamped together by a tie-bolt case.

22 Claims, 3 Drawing Sheets

ENGINE CASE SYSTEM FOR A GAS TURBINE ENGINE

CROSS REFERENCE TO RELATED APPLICATIONS

The present application claims the benefit of U.S. Provisional Patent Application No. 61/203,893, filed Dec. 30, 2008, and is incorporated herein by reference.

GOVERNMENT RIGHTS

The present application was made with the United States government support under Contract No. F33615-03-D-2357, awarded by the U.S. Navy. The United States government may have certain rights in the present application.

FIELD OF THE INVENTION

The present invention relates generally to gas turbine engines, and, more particularly, to an engine case system for a gas turbine engine.

BACKGROUND

Gas turbine engine cases that house rotating and static components, including blades and vanes, remain an area of interest. Some existing systems have various shortcomings, drawbacks, and disadvantages relative to certain applications. Accordingly, there remains a need for further contributions in this area of technology.

SUMMARY

The present invention provides engine case systems for gas turbine engines. Embodiments of the engine case systems include a plurality of ring cases and a tie-bolt case. The ring cases may house blades and/or vanes for the compressor and/or for the turbine. The ring cases may be stacked in series, and may be clamped together by a tie-bolt case.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
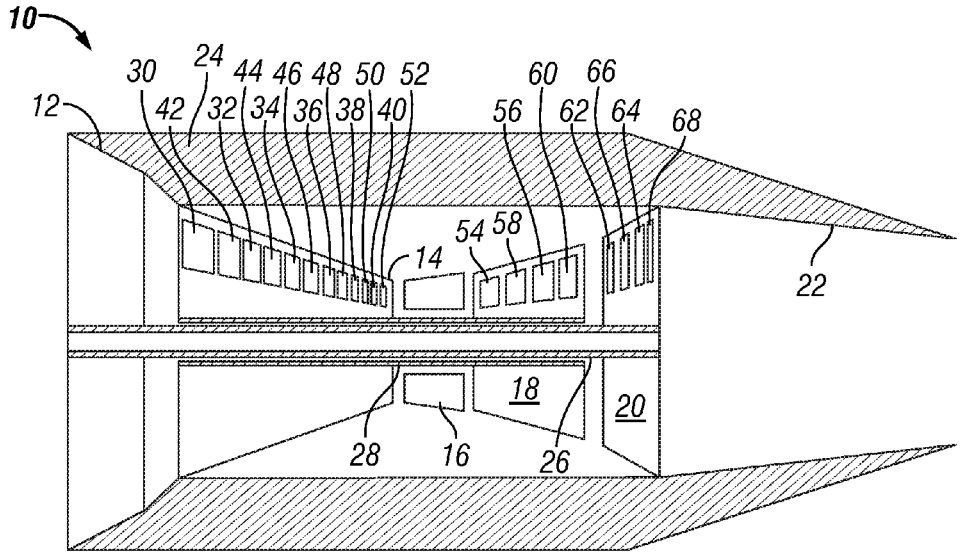
FIG. 1 schematically depicts a gas turbine engine in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Referring now to the drawings, and in particular, FIG. 1, a non-limiting example of a gas turbine engine 10 in accordance with an embodiment of the present invention is schematically depicted. In one form, gas turbine engine 10 is a turbofan engine, e.g., an aircraft propulsion powerplant. In other embodiments, gas turbine engine 10 may be another gas turbine engine configuration, for example, including a turbojet engine, a turboprop engine, or a turboshaft engine. In the embodiment of FIG. 1, various features, components and interrelationships therebetween of aspects of an embodiment of the present invention are depicted. However, the present invention is not limited to the particular embodiment of FIG. 1 and the components, features and interrelationships therebetween as are illustrated in FIG. 1 and described herein.

In the illustrated embodiment, gas turbine engine 10 includes a fan 12, a compressor 14, a combustor 16, a high pressure (HP) turbine 18, a low pressure (LP) turbine 20, an exhaust nozzle 22 and a bypass duct 24. Combustor 16 is fluidly disposed between compressor 14 and HP turbine 18. LP turbine 20 is drivingly coupled to fan 12 via an LP shaft 26. HP turbine 18 is drivingly coupled to compressor 14 via an HP shaft 28. Although depicted in the form of a two-spool engine, it will be understood that the present invention is equally applicable to three-spool engines or single spool engines.

Each of compressor 14, HP turbine 18 and LP turbine 20 include a plurality of vanes and blades in one or more stages, e.g., compressor vanes 30, 32, 34, 36, 38 and 40; compressor blades 42, 44, 46, 48, 50 and 52; HP turbine vanes 54 and 56; HP turbine blades 58 and 60; and LP turbine vanes 62 and 64 and LP turbine blades 66 and 68. Although a particular number of compressor and turbine stages are depicted for each of compressor 14, LP turbine 20 and HP turbine 18, it will be understood that the depictions are illustrative examples only, and that any particular number of compressor or turbine stages may be employed in embodiments of the present invention.

During the operation of gas turbine engine 10, air is drawn into the inlet of fan 12 and pressurized by fan 12. Some of the air pressurized by fan 12 is directed into compressor 14, and the balance is directed into bypass duct 24. Bypass duct 24 directs the pressurized air to exhaust nozzle 22, which provides a component of the thrust output by gas turbine engine 10. Compressor 14 receives the pressurized air from fan 12, and further pressurizes the air using compressor vanes 30, 32, 34, 36, 38 and 40, and compressor blades 42, 44, 46, 48, 50 and 52.

The pressurized air discharged from compressor 14 is then directed to combustor 16. Fuel is mixed with air in combustor 16, and the mixture is then combusted in a combustion liner (not shown). The hot gases exiting combustor 16 are directed into HP turbine 18, which extracts energy from the hot gases in the form of mechanical shaft power to drive compressor 14 via HP shaft 28. The energy is extracted from the hot gases using HP turbine vanes 54 and 56, and HP turbine blades 58 and 60.

The hot gases exiting HP turbine 18 are directed into LP turbine 20, which extracts energy in the form of mechanical shaft power to drive fan 12 via LP shaft 26. The energy is extracted from the hot gases using LP turbine vanes 62 and 64, and LP turbine blades 66 and 68. The hot gases exiting LP turbine 20 are directed into nozzle 22, and provide a component of the thrust output by gas turbine engine 10.

Compressor 14 includes an engine case system. The engine case system includes individual ring cases that house each of compressor vanes 30, 32, 34, 36, 38 and 40, and compressor blades 42, 44, 46, 48, 50 and 52. In one form, each ring case houses a single vane stage and a single stage of blades. In other embodiments, each ring case may house only a single stage of blades or a single stage of vanes. In still other embodiments, the ring cases may house one or more stages of blades and vanes. In some embodiments, the ring cases may house other components in addition to or in place of blades and/or vanes. Although an embodiment is described herein with respect to compressor cases, it will be understood that the present invention is equally applicable to turbine cases. The individual cases are referred to as "ring" cases because they do not include horizontal split lines. The ring cases are stacked in series, and are clamped together by a tie-bolt case. A "tie-bolt" case is a gas turbine engine case that carries a clamp load to axially clamp together a plurality of stacked ring cases, e.g., as described herein, wherein the ring cases have boltless interfaces between each adjacent case, in contrast to engine case systems having cases with bolt flanges that are held together in the axial direction by bolting one or more flanges to adjacent one or more flanges. In one form, a single tie-bolt case is employed. In other embodiments more than one tie-bolt case may be employed. In still other embodiments, all or part of one or more tie-bolt cases may extend from one or more ring cases. The tie-bolt case(s) is coupled in tension between (loadwise) the first ring case and the last ring case of two or more stacked ring cases in such a manner that the tensile load in the tie-bolt case generates a compressive load in and between the ring cases that keeps the ring cases in contact with each other.

Figure 2A:
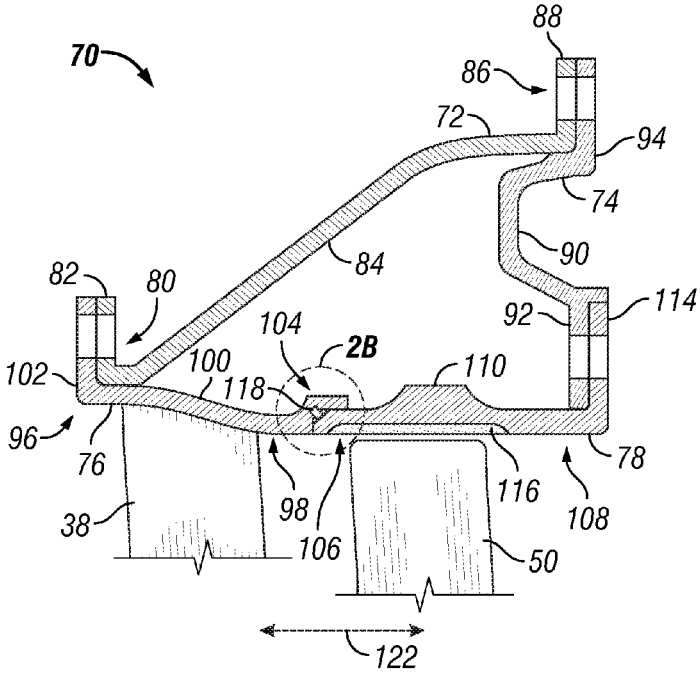
FIGS. 2A and 2B are cross-sections of an engine case system in accordance with an embodiment of the present invention.
Figure 2B:
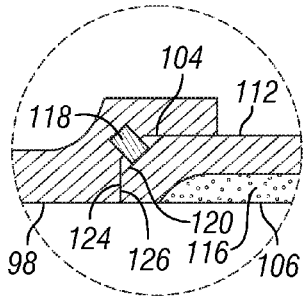

With reference to FIGS. 2A and 2B there is illustrated a non-limiting example of a an engine case system 70 in accordance with an embodiment of the present invention is depicted in cross section. In one form, engine case system 70 is a compressor case system employed in compressor 14. In other embodiments, engine case system 70 may be a turbine case system. In the embodiment of FIGS. 2A and 2B, various features, components and interrelationships therebetween of aspects of an embodiment of the present invention are depicted. However, the present invention is not limited to the particular embodiment of FIGS. 2A and 2B and the components, features and interrelationships therebetween as are illustrated in FIGS. 2A and 2B and described herein.

FIGS. 2A and 2B illustrate an embodiment in partial cross-section of an engine case system in the form of a compressor case system 70. In one form, compressor case system 70 includes a tie-bolt case 72, a tie-bolt case 74, a ring case 76 and a ring case 78. Tie-bolt case 72 is structured to clamp ring case 76 and ring case 78 together. Other embodiments may employ more than two ring cases clamped together with tie-bolt case 72 and/or with one or more additional tie-bolt cases.

In one form, tie-bolt case 72 includes an end portion 80 culminating in a flange 82, and includes a body 84, and an end portion 86 culminating in a flange 88. Body 84 extends between end portion 80 and end portion 86. In one form, tie-bolt case 74 includes a body 90 extending between a flange 92 and a flange 94. Each of tie-bolt case 72 and tie-bolt case 74 are bodies of revolution. Flange 94 of tie-bolt case 74 is bolted to flange 88 of tie-bolt case 72 during the assembly of gas turbine engine 10. In other embodiments, tie-bolt cases 72 and 74 may take other geometric forms suitable for clamping a plurality of ring cases together.

In one form, ring case 76 includes a forward end 96, an aft end 98 and a body 100 extending between forward end 96 and aft end 98. Forward end 96 includes a flange 102 that is bolted to flange 82 of tie-bolt case 72 during the assembly of gas turbine engine 10. Aft end 98 includes a piloting feature 104, which in the present embodiment is an inside pilot diameter. Ring case 76 of the present embodiment is a body of revolution, and houses a plurality of circumferentially spaced compressor vanes, e.g., vanes 38. In other embodiments, ring case 76 may take other geometric forms suitable for being clamped to ring case 76 via one or more tie-bolt cases such as tie-bolt cases 72 and 74.

In one form, ring case 78 includes a forward end 106, an aft end 108 and a body 110 extending between forward end 106 and aft end 108. Forward end 106 includes a piloting feature 112, which in the present embodiment is an outside pilot diameter. Piloting feature 112 of ring case 78 engages pilot diameter 104 of ring case 76 to pilot the two ring cases relative to each other. Aft end 108 includes a flange 114 that is bolted to flange 92 of tie-bolt case 74 during the assembly of gas turbine engine 10. Ring case 78 of the present embodiment is a body of revolution, and houses a plurality of circumferentially spaced compressor blades, e.g., blades 50. In other embodiments, ring case 78 may take other geometric forms suitable for being clamped to ring case 78 via one or more tie-bolt cases such as tie-bolt cases 72 and 74.

In one form, ring case 78 also includes an abradable treatment 116, such as an abradable coating, which is located opposite blades 50. Other embodiments may not include an abradable treatment. In one form, anti-rotation between ring case 76 and ring case 78 is provided by a plurality of circumferentially spaced anti-rotation pins 118 that extend from aft end portion 98 into an angled slot 120 in forward end portion 106. Other types of anti-rotation means may be employed in other embodiments of the present invention, e.g., a spline coupling or a curvic coupling, which may also serve as the piloting feature. Some embodiments may not include an anti-rotation feature.

Tie-bolt cases 72 and 74 are coupled in parallel to ring cases 76 and 78, providing parallel loadpaths. That is, a tensile loadpath through tie-bolt cases 72 and 74, generated by a clamp load, which is in parallel to a compressive loadpath through ring cases 76 and 78, also generated by the clamp load. In one form, the pre-assembly dimension between the inner faces of flanges 102 and 114 in axial direction 122 is greater than the pre-assembly dimension between the outer faces of flanges 82 and 92 in axial direction 122. When flanges 82 and 102; flanges 88 and 94; and flanges 92 and 114 are bolted together during the assembly of compressor 14, those dimensions are forced to be the same, thereby deflecting the cases and resulting in the clamp load that clamps ring case 76 and ring case 78 together, and resulting in tension in tie-bolt case 72, e.g., in body 84. Ring cases 76 and 78 are clamped together at end faces 124 and 126 by virtue of the clamp load generated in case system 70, without the use of bolts at end portions 98 and 106. End face 124 in conjunction with piloting feature 104, and end face 126 in conjunction with piloting feature 112 thus form boltless interfaces on the respective ring cases 76 and 78. In other embodiments, the clamp load may not be present at assembly, but may be the result of differential thermal growth as between the ring cases 76 and 78 relative to tie-bolt cases 72 and 74.

The amount of clamp load may be varied according to the needs of gas turbine engine 10, e.g., depending upon the temperature profiles of the cases anticipated during the operations of gas turbine engine 10, as well as the pressures in and about compressor 14, and any g-loading and/or gyro loading anticipated during the operations of gas turbine engine 10. In some embodiments, the clamp load may increase with case temperature, whereas in other embodiments, the clamp load may remain the same or decrease with temperature, e.g., depending upon the materials selected for cases 72, 74, 76 and 78.

Figure 3:
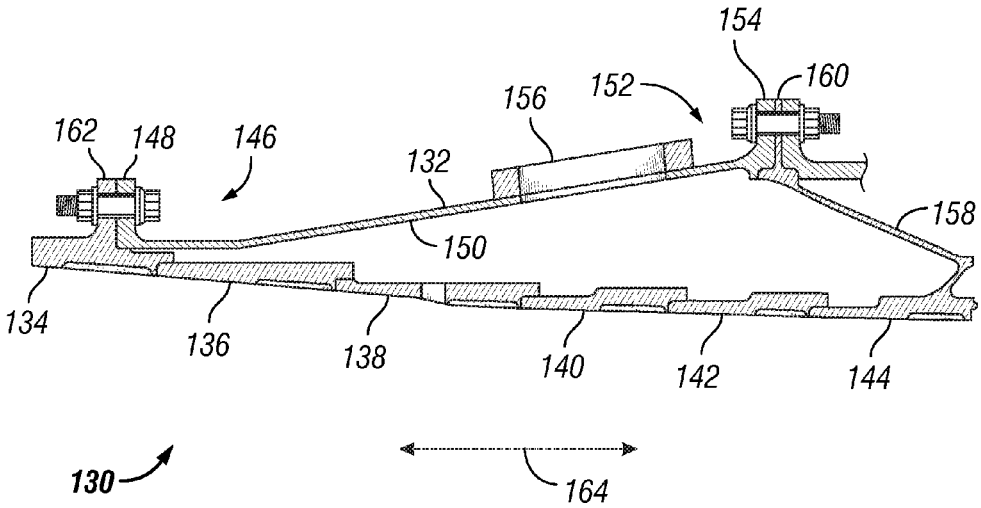
FIG. 3 is a cross section of an engine case system in accordance with another embodiment of the present invention.

Referring now to FIG. 3, a non-limiting example of another embodiment of an engine case system, illustrated as engine case system 130 is depicted in cross section. In one form, engine case system 130 is a compressor case system. In other embodiments, engine case system may be a turbine case system. In the embodiment of FIG. 3, various features, components and interrelationships therebetween of aspects of an embodiment of the present invention are depicted. However, the present invention is not limited to the particular embodiment of FIG. 3 and the components, features and interrelationships therebetween as are illustrated in FIG. 3 and described herein.

In one form, engine case system 130 includes a tie-bolt case 132 and ring cases 134, 136, 138, 140, 142 and 144. In other embodiments, engine case system 130 may include more or less ring cases. Tie-bold case 132 is structured to clamp ring cases 134, 136, 138, 140, 142 and 144 together. In one form, tie-bolt case 132 is larger in diameter than ring cases 134, 136, 138, 140, 142 and 144. In one form, tie-bolt case 132 includes an end portion 146 culminating in a flange 148, and includes a body 150 and an end portion 152 culminating in a flange 154. Body 150 extends between end portion 146 and end portion 152. In one form, tie-bolt case 132 is a body of revolution, the frustum of a cone in the present embodiment, and includes a bleed port 156 for bleeding pressurized air from compressor 14. In other embodiments, tie-bolt case 132 may be cylindrical. In yet other embodiments, other bodies of revolution and/or other geometric forms suitable for clamping a plurality of ring cases together may be employed.

In one form, each of ring cases 134, 136, 138, 140, 142 and 144 house a plurality of circumferentially spaced compressor vanes and/or a plurality of compressor blades (not shown), such as described above with respect to FIGS. 2A and 2B. In other embodiments, ring cases 134, 136, 138, 140, 142 and 144 may house turbine blades and/or turbine vanes. In still other embodiments, ring cases 134, 136, 138, 140, 142 and 144 may house other components in addition to or in place of blades and/or vanes. In one form, ring case 144, the last ring case in the serially stacked ring cases 134, 136, 138, 140, 142 and 144, includes a body of revolution 158 culminating at a flange 160. Ring case 134, the first ring case in the serially stacked ring cases 134, 136, 138, 140, 142 and 144, also includes a flange 162. In one form, ring cases 134, 136, 138, 140, 142 and 144 are piloted and anti-rotated relative to each other in the same manner as that set forth above with respect to the embodiment of FIGS. 2A and 2B. In other embodiments, other piloting schemes and anti-rotation schemes may be employed. Ring cases 134, 136, 138, 140, 142 and 144 have boltless interfaces for interfacing with adjacent ring cases, e.g., as described above with respect to FIGS. 2A and 2B.

Tie-bolt case 132 is coupled in parallel to ring cases 134, 136, 138, 140, 142 and 144, providing parallel loadpaths, similar to that set forth above with respect to the embodiment of FIGS. 2A and 2B. One loadpath is predominantly in tension through tie-bolt case 132 and the other loadpath is predominantly in compression through the serially stacked ring cases 134, 136, 138, 140, 142 and 144, not including body of revolution 158, which is predominantly in tension. In one form, the pre-assembly dimension between the inner faces of flanges 162 and 160 in axial direction 164 is greater than the pre-assembly dimension between the outer faces of flanges 148 and 154 in axial direction 164. When flanges 162 and 148 and flanges 154 and 160 are bolted together during the assembly of compressor 14, those dimensions are forced to be the same, thereby deflecting the cases and resulting in a clamp load that clamps ring cases 134, 136, 138, 140, 142 and 144 together, and resulting in tension in tie-bolt case 132, e.g., in body 150. Ring cases 134, 136, 138, 140, 142 and 144 are clamped together by virtue of the clamp load generated in tie-bolt case 132, without the use of bolts between each ring case. In other embodiments, the clamp load may not be present at assembly, but may be the result of differential thermal growth as between the ring cases 134, 136, 138, 140, 142 and 144 relative to tie-bolt case 132.

The amount of clamp load may be varied according to the needs of gas turbine engine 10, e.g., depending upon the temperature profiles of the cases anticipated during the operations of gas turbine engine 10, as well as the pressures in and about compressor 14, and any g-loading and/or gyro loading anticipated during the operations of gas turbine engine 10. In some embodiments, the clamp load may increase with case temperature, whereas in other embodiments, the clamp load may remain the same or decrease with temperature, e.g., depending upon the materials selected for ring cases 134, 136, 138, 140, 142 and 144 and tie-bolt case 132.

Figure 4:
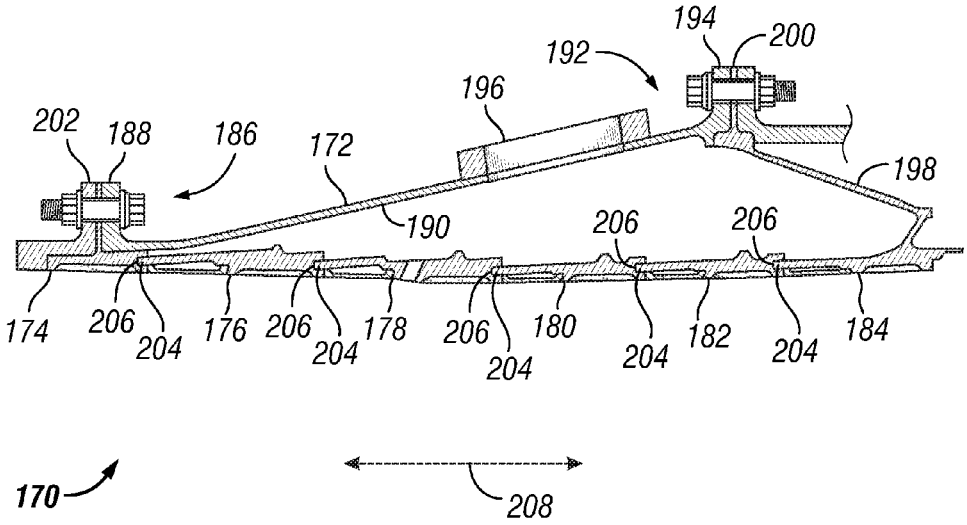
FIG. 4 is a cross section of an engine case system in accordance with yet another embodiment of the present invention.

Referring now to FIG. 4, a cross section of another embodiment of an engine case system 170 is depicted. In one form, engine case system 170 is a compressor case system. In other embodiments, case system 170 may be a turbine case system or another gas turbine engine case system. In the embodiment of FIG. 4, various features, components and interrelationships therebetween of aspects of an embodiment of the present invention are depicted. However, the present invention is not limited to the particular embodiment of FIG. 4 and the components, features and interrelationships therebetween as are illustrated in FIG. 4 and described herein.

In one form, engine case system 170 includes a tie-bolt case 172 and ring cases 174, 176, 178, 180, 182 and 184. In other embodiments, engine case system 170 may include more or less ring cases. Tie-bold case 172 is structured to clamp ring cases 174, 176, 178, 180, 182 and 184 together. In one form, tie-bolt case 172 is larger in diameter than ring cases 174, 176, 178, 180, 182 and 184. In one form, tie-bolt case 172 includes an end portion 186 culminating in a flange 188, and includes a body 190 and an end portion 192 culminating in a flange 194. Body 190 extends between end portion 186 and end portion 192. In one form, tie-bolt case 172 is a body of revolution, the frustum of a cone in the present embodiment, and includes a bleed port 196 for bleeding pressurized air from compressor 14. In other embodiments, tie-bolt case 172 may be cylindrical. In yet other embodiments, other bodies of revolution and/or other geometric forms suitable for clamping a plurality of ring cases together may be employed.

In one form, each of ring cases 174, 176, 178, 180, 182 and 184 house a plurality of circumferentially spaced compressor vanes and/or a plurality of compressor blades (not shown), such as described above with respect to FIGS. 2A and 2B. In other embodiments, ring cases 174, 176, 178, 180, 182 and 184 may house turbine blades and/or turbine vanes. In still other embodiments, ring cases 174, 176, 178, 180, 182 and 184 may house other components in addition to or in place of blades and/or vanes. In one form, ring case 184, the last ring case in the serially stacked ring cases 174, 176, 178, 180, 182 and 184, includes a body of revolution 198 culminating at a flange 200. Ring case 174, the first ring case in the serially stacked ring cases 174, 176, 178, 180, 182 and 184, also includes a flange 202. In one form, ring cases 174, 176, 178, 180, 182 and 184 are anti-rotated relative to each other in the same manner as that set forth above with respect to the embodiment of FIGS. 2A and 2B. In other embodiments, other anti-rotation schemes may be employed. In one form, ring cases 174, 176, 178, 180, 182 and 184 are piloted relative to each other using a tongue and groove arrangement, e.g., with a tongue 204 and groove 206 at each interface. In other embodiments, other piloting schemes may be employed. As with the previously described embodiments, ring cases 174, 176, 178, 180, 182 and 184 have boltless interfaces for interfacing with adjacent ring cases.

Tie-bolt case 172 is coupled in parallel to ring cases 174, 176, 178, 180, 182 and 184, providing parallel loadpaths, similar to that set forth above with respect to the embodiment of FIGS. 2A and 2B. One loadpath is predominantly in tension through tie-bolt case 172 and the other loadpath is predominantly in compression through the serially stacked ring cases 174, 176, 178, 180, 182 and 184, not including body of revolution 198, which is predominantly in tension. In one form, the pre-assembly dimension between the inner faces of flanges 200 and 202 in axial direction 208 is greater than the pre-assembly dimension between the outer faces of flanges 188 and 194 in axial direction 208. When flanges 202 and 188 and flanges 194 and 200 are bolted together during the assembly of compressor 14, those dimensions are forced to be the same, thereby deflecting the cases and resulting in a clamp load that clamps ring cases 174, 176, 178, 180, 182 and 184 together, and resulting in tension in tie-bolt case 172, e.g., in body 190. Ring cases 174, 176, 178, 180, 182 and 184 are clamped together by virtue of the clamp load generated in tie-bolt case 172, without the use of bolts between each ring case. In other embodiments, the clamp load may not be present at assembly, but may be the result of differential thermal growth as between the ring cases 174, 176, 178, 180, 182 and 184 relative to tie-bolt case 172.

The amount of clamp load may be varied according to the needs of gas turbine engine 10, e.g., depending upon the temperature profiles of the cases anticipated during the operations of gas turbine engine 10, as well as the pressures in and about compressor 14, and any g-loading and/or gyro loading anticipated during the operations of gas turbine engine 10. In some embodiments, the clamp load may increase with case temperature, whereas in other embodiments, the clamp load may remain the same or decrease with temperature, e.g., depending upon the materials selected for ring cases 174, 176, 178, 180, 182 and 184 and tie-bolt case 172.

Figure 5:
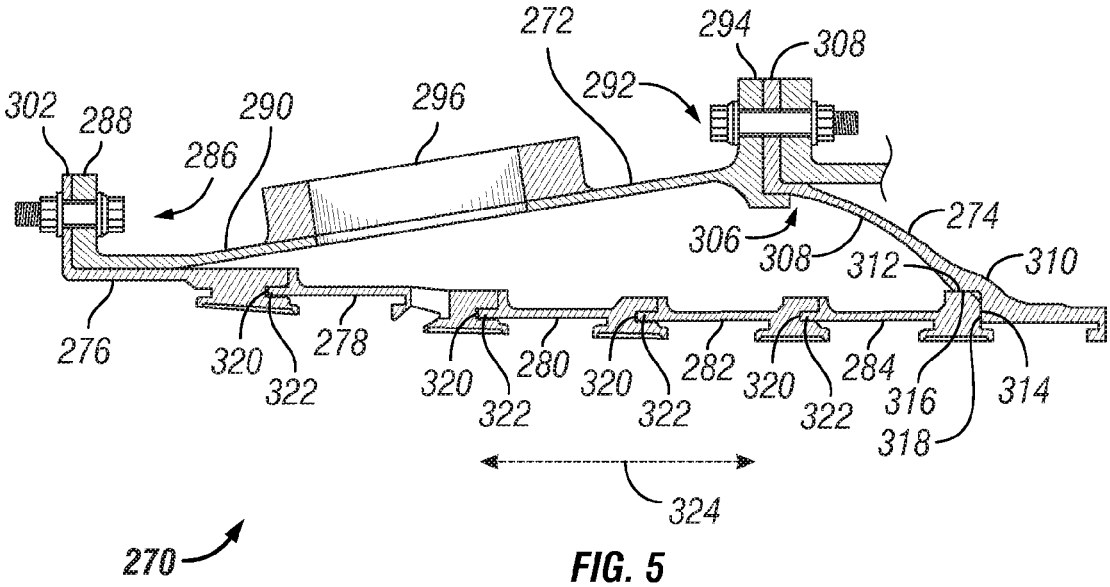
FIG. 5 is a cross section of an engine case system in accordance with still another embodiment of the present invention.

Referring now to FIG. 5, a cross section of another embodiment of an engine case system 270 is depicted. In one form, engine case system 270 is a compressor case system. In other embodiments, case system 270 may be a turbine case system or another gas turbine engine case system. In the embodiment of FIG. 5, various features, components and interrelationships therebetween of aspects of an embodiment of the present invention are depicted. However, the present invention is not limited to the particular embodiment of FIG. 5 and the components, features and interrelationships therebetween as are illustrated in FIG. 5 and described herein.

In one form, engine case system 270 includes tie-bolt cases 272 and 274, and ring cases 276, 278, 280, 282 and 284. Tie-bold cases 272 and 274 are structured to clamp ring cases 276, 278, 280, 282 and 284 together. Tie bold-cases 272 and 274 are coupled in tension between ring cases 276 and 284, which places ring cases 276, 278, 280, 282 and 284 in compression, thereby clamping ring cases 276, 278, 280, 282 and 284 together. In other embodiments, engine case system 270 may include more or less ring cases and/or more or less tie-bolt cases to carry a tensile load to clamp the ring cases together.

In one form, tie-bolt case 272 is larger in diameter than ring cases 276, 278, 280, 282 and 284. In one form, tie-bolt case 272 includes an end portion 286 culminating in a flange 288, and includes a body 290 and an end portion 292 culminating in a flange 294. Body 290 extends between end portion 286 and end portion 292. In one form, tie-bolt case 272 is a body of revolution, the frustum of a cone in the present embodiment, and includes a bleed port 296 for bleeding pressurized air from compressor 14. In other embodiments, tie-bolt case 272 may be cylindrical. In yet other embodiments, other bodies of revolution and/or other geometric forms suitable for clamping a plurality of ring cases together may be employed.

In one form, tie-bolt case 274 is larger in diameter than ring cases 276, 278, 280, 282 and 284. In one form, tie-bolt case 274 includes an end portion 306 culminating in a flange 308, and includes a body 308 and an end portion 310 having a pilot diameter 312 and face 314 for respsectively radially positioning with respsect to and clamping onto ring case 284. Body 308 extends between end portion 306 and end portion 310. In one form, tie-bolt case 274 is a curved body of revolution. In other embodiments, tie-bolt case 274 may be cylindrical. In yet other embodiments, other bodies of revolution and/or other geometric forms suitable for clamping a plurality of ring cases together may be employed.

In one form, each of ring cases 276, 278, 280, 282 and 284 house a plurality of circumferentially spaced compressor vanes and/or a plurality of compressor blades (not shown), such as described above with respect to FIGS. 2A and 2B. In other embodiments, ring cases 276, 278, 280, 282 and 284 may house turbine blades and/or turbine vanes. In still other embodiments, ring cases 276, 278, 280, 282 and 284 may house other components in addition to or in place of blades and/or vanes. In one form, ring case 284, the last ring case in the serially stacked ring cases 276, 278, 280, 282 and 284, includes a pilot diameter 316 and end face 318 interacting with tie-bolt case 274 to pilot, position and transmit clamp loads into ring cases 276, 278, 280, 282 and 284. Ring case 276, the first ring case in the serially stacked ring cases 276, 278, 280, 282 and 284, includes a flange 302. In one form, ring cases 276, 278, 280, 282 and 284 are anti-rotated relative to each other in the same manner as that set forth above with respect to the embodiment of FIGS. 2A and 2B. In other embodiments, other anti-rotation schemes may be employed. In one form, ring cases 276, 278, 280, 282 and 284 are piloted relative to each other using a tongue and groove arrangement, e.g., with a tongue 320 and groove 322 at each interface. In other embodiments, other piloting schemes may be employed. As with the previously described embodiments, ring cases 276, 278, 280, 282 and 284 have boltless interfaces for interfacing with adjacent ring cases.

Tie-bolt cases 272 and 274 are coupled in series with respect to each other, and as a group are coupled in parallel to ring cases 276, 278, 280, 282 and 284, providing parallel loadpaths, similar to that set forth above with respect to the embodiment of FIGS. 2A and 2B. One loadpath is predominantly in tension through tie-bolt cases 272 and 274 and the other loadpath is predominantly in compression through the serially stacked ring cases 276, 278, 280, 282 and 284. In one form, the pre-assembly dimension between the inner faces of flanges 302 and 308 in axial direction 324 is greater than the pre-assembly dimension between the outer faces of flanges 288 and 294 in axial direction 324. When flanges 302 and 288 and flanges 294 and 308 are bolted together during the assembly of compressor 14, those dimensions are forced to be the same, thereby deflecting the cases and resulting in a clamp load that clamps ring cases 276, 278, 280, 282 and 284 together, and resulting in tension in tie-bolt cases 272 and 274, e.g., in bodies 290 and 308. Ring cases 276, 278, 280, 282 and 284 are clamped together by virtue of the clamp load generated in tie-bolt case 272 and 274, without the use of any bolted flanges between ring cases. In other embodiments, the clamp load may not be present at assembly, but may be the result of differential thermal growth as between the ring cases 276, 278, 280, 282 and 284 relative to tie-bolt cases 272 and 274.

The amount of clamp load may be varied according to the needs of gas turbine engine 10, e.g., depending upon the temperature profiles of the cases anticipated during the operations of gas turbine engine 10, as well as the pressures in and about compressor 14, and any g-loading and/or gyro loading anticipated during the operations of gas turbine engine 10. In some embodiments, the clamp load may increase with case temperature, whereas in other embodiments, the clamp load may remain the same or decrease with temperature, e.g., depending upon the materials selected for ring cases 276, 278, 280, 282 and 284 and tie-bolt cases 272 and 274.

In view of the foregoing, embodiments of the present invention include an engine case system for a gas turbine engine. The engine case system may include a plurality of ring cases stacked in series, each ring case of the plurality of ring cases housing at least one of a rotor and a stator of one of a compressor and a turbine, each ring case of the plurality of ring cases having a boltless interface for interfacing with an adjacent ring case of the plurality of ring cases stacked in series; and a tie-bolt case coupled in tension to a first ring case of the plurality of ring cases and to a last ring case of the plurality of ring cases to clamp together the plurality of ring cases stacked in series. The tie-bolt case may be coupled in parallel to the plurality of ring cases stacked in series. The first ring case may have a first flange, and the last ring case may have a second flange, and the tie-bolt case may have a first end portion and a second end portion; and the tie-bolt case may be bolted at the first end portion to the first flange and at the second end portion to the second flange.

The tie-bolt case may have a larger diameter than any ring bases of the plurality of ring cases. Each ring case may include a piloting feature structure to pilot the adjacent ring case. The piloting feature may be in the form of a pilot diameter arranged to pilot the adjacent ring case. In some embodiments, the piloting feature may be in the form of one of a tongue and a groove of a tongue and groove arrangement. At least one ring case of the plurality of ring cases may include an anti-rotation feature structured to anti-rotate the each ring case relative to the adjacent ring case.

Other embodiments of the present invention may include an engine case system for a gas turbine engine. The engine case system may include a plurality ring cases stacked in series, each ring case housing at least one of a rotor and a stator of one of a compressor and a turbine, each ring case of the plurality of ring cases having a boltless interface with an adjacent ring case of the plurality of stacked ring cases; and means for coupling together the plurality of ring cases. The means for coupling may include means for clamping together the plurality of ring cases. The means for coupling may include means for piloting adjacent ring cases of the plurality of ring cases. The means for coupling may include means for anti-rotating at least one ring case of the plurality of ring cases.

Still other embodiments of the present invention may include an engine case system for a gas turbine engine. The engine case system may include a first ring case disposed around at least one of a plurality of circumferentially spaced vanes of the gas turbine engine and a plurality of circumferentially spaced blades of the gas turbine engine, the first ring case having a first ring case aft end; a second ring case disposed around at least an other plurality of circumferentially spaced vanes of the gas turbine engine and an other plurality of circumferentially spaced blades of the gas turbine engine, the second ring case having a second ring case forward end, the second ring case forward end facing toward the first ring case aft end; and a body of revolution disposed at least partially around at least one of the first ring case and the second ring case, the body of revolution structured to carry a clamping load clamping together the first ring case and the second ring case. The first ring case may have a first ring case forward end, the second ring case may have a second ring case aft end, and the body of revolution may be structured to carry the clamping load between the first ring case forward end and the second ring case aft end. The body of revolution may be at least one of a cylinder and a frustum of a cone. The plurality of vanes and the plurality of blades may be turbine stages, and/or, the plurality of vanes and the plurality of blades may be compressor stages.

The engine case system may include a third ring case disposed around at least one of a further plurality of circumferentially spaced vanes of the gas turbine engine and a further plurality of circumferentially spaced blades of the gas turbine engine, the third ring case being clamped between the first ring case and the second ring case by the clamping load.

A second body of revolution may be disposed at least partially around at least one the first ring case and the second ring case, the second body of revolution also structured to carry the clamping load.

Yet other embodiments of the present invention may include a gas turbine engine. The gas turbine engine may include a compressor; a turbine; and a combustor fluidly disposed between the compressor and the turbine, wherein at least one of the compressor and the turbine include an engine case system. The engine case system may include a plurality ring cases stacked in series, each ring case housing at least one of a rotor and a stator of one of the compressor and the turbine, each ring case of the plurality of ring cases having a boltless interface with an adjacent ring case of the plurality of ring cases stacked in series; and a tie-bolt case coupled in tension to a first ring case of the plurality of ring cases and to a last ring case of the plurality of ring cases to clamp together the plurality of ring cases stacked in series.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. An engine case system for a gas turbine engine, comprising;

a plurality of ring cases stacked in series, wherein each ring case of said plurality of ring cases houses at least one of a rotor and a stator of one of a compressor and a turbine; and wherein each ring case of said plurality of ring cases has a boltless interface for interfacing with an adjacent ring case of said plurality of ring cases stacked in series; and a tie-bolt case coupled in tension between a first ring case of said plurality of ring cases and a last ring case of said plurality of ring cases to clamp together said plurality of ring cases stacked in series.

2. The engine case system of claim 1, wherein said tie-bolt case is coupled in parallel to said plurality of ring cases stacked in series.

3. The engine case system of claim 2, wherein said first ring case has a first flange, said last ring case has a second flange, wherein said tie-bolt case has a first end portion and a second end portion, and wherein said tie-bolt case is bolted at said first end portion to said first flange and at said second end portion to said second flange.

4. The engine case system of claim 1, wherein said tie-bolt case has a larger diameter than any ring bases of said plurality of ring cases.

5. The engine case system of claim 1, wherein said each ring case includes a piloting feature structured to pilot said adjacent ring case.

6. The engine case system of claim 5, wherein said piloting feature is in the form of a pilot diameter arranged to pilot said adjacent ring case.

7. The engine case system of claim 5, wherein said piloting feature is in the form of one of a tongue and a groove of a tongue and groove arrangement.

8. The engine case system of claim 1, wherein at least one ring case of said plurality of ring cases includes an anti-rotation feature structured to anti-rotate said each ring case relative to said adjacent ring case.

9. The engine case system of claim 1, further comprising an other tie-bolt case coupled in tension between said first ring case of said plurality of ring cases and said last ring case of said plurality of ring cases to clamp together said plurality of ring cases stacked in series.

10. The engine case system of claim 9, wherein said other tie-bolt case is coupled in series with said tie-bolt case.

11. An engine case system for a gas turbine engine, comprising:

a plurality of ring cases stacked in series, wherein each ring case of said plurality of ring cases houses at least one of a rotor and a stator of one of a compressor and a turbine; and wherein each of said ring cases has a boltless interface with an adjacent ring case of said plurality of ring cases stacked in series; and means for coupling together said plurality of ring cases.

12. The engine case system of claim 11, wherein said means for coupling includes means for clamping said plurality of ring cases together.

13. The engine case system of claim 11, wherein said means for coupling includes means for piloting adjacent ring cases of said plurality of ring cases relative to each other.

14. The engine case system of claim 11, wherein said means for coupling includes means for anti-rotating at least one ring case of said plurality of ring cases.

15. An engine case system for a gas turbine engine, comprising:

a first ring case disposed around at least one of a plurality of circumferentially spaced vanes of said gas turbine engine and a plurality of circumferentially spaced blades of said gas turbine engine, wherein said first ring case has a first ring case aft end;

a second ring case disposed around at least one of an other plurality of circumferentially spaced vanes of said gas turbine engine and an other plurality of circumferentially spaced blades of said gas turbine engine; wherein said second ring case has a second ring case forward end; and wherein said second ring case forward end faces toward said first ring case aft end; and a body of revolution disposed at least partially around at least one of said first ring case and said second ring case, wherein said body of revolution is structured to carry a clamping load clamping together said first ring case and said second ring case.

16. The engine case system of claim 15, wherein said first ring case has a first ring case forward end, wherein said second ring case has a second ring case aft end, and wherein said body of revolution is structured to carry said clamping load between said first ring case forward end and said second ring case aft end.

17. The engine case of claim 15, wherein said body of revolution is at least one of a cylinder and a frustum of a cone.

18. The engine case of claim 15, wherein said plurality of vanes and said plurality of blades are turbine stages.

19. The engine case of claim 15, wherein said plurality of vanes and said plurality of blades are compressor stages.

20. The engine case of claim 15, further comprising a third ring case disposed around at least one of a further plurality of circumferentially spaced vanes of said gas turbine engine and a further plurality of circumferentially spaced blades of said gas turbine engine, said third ring case being clamped between said first ring case and said second ring case by said clamping load.

21. The engine case of claim 15, further comprising a second body of revolution disposed at least partially around at least one said first ring case and said second ring case, wherein said second body of revolution is also structured to carry said clamping load.

22. A gas turbine engine, comprising:

a compressor;

a turbine; and a combustor fluidly disposed between said compressor and said turbine, wherein at least one of said compressor and said turbine include an engine case system, the engine case system including:

a plurality ring cases stacked in series, wherein each ring case houses at least one of a rotor and a stator of one of said compressor and said turbine; and wherein each ring case of said plurality of ring cases has a boltless interface with an adjacent ring case of said plurality of ring cases stacked in series; and a tie-bolt case coupled in tension between a first ring case of said plurality of ring cases and a last ring case of said plurality of ring cases to clamp together said plurality of ring cases stacked in series.

* * * * *